US007588048B2

(12) United States Patent
Huang

(10) Patent No.: US 7,588,048 B2
(45) **Date of Patent: *Sep. 15, 2009**

(54) AIR PUMP NOZZLE

(76) Inventor: Ying-Che Huang, No. 111, Lane Tzeng-Fu, Tzeng-Tsuo Tsuen, Shiou-Shuei Shiang, Chang-Hua Hsien, Chang-Hua Hsien, 504 (TW)

( * ) Notice: Subject to any disclaimer, the term of this patent is extended or adjusted under 35 U.S.C. 154(b) by 463 days.

This patent is subject to a terminal disclaimer.

(21) Appl. No.: 11/420,004

(22) Filed: May 24, 2006

(65) Prior Publication Data

US 2007/0272301 A1 Nov. 29, 2007

(51) Int. Cl.
*F16K 15/20* (2006.01)

(52) U.S. Cl. ..... 137/231; 137/223

(58) Field of Classification Search ..... 137/223, 137/228, 230, 231, 233
See application file for complete search history.

(56) References Cited

U.S. PATENT DOCUMENTS 1,245,115 A * 10/1917 McEwen ..... 137/231
1,362,804 A * 12/1920 Kraft ..... 137/223
1,874,915 A * 8/1932 Crowley ..... 137/223
2,027,956 A * 1/1936 Bowser ..... 137/231
2,149,681 A * 3/1939 Johnston ..... 137/231
2,918,076 A * 12/1959 Dockrell ..... 137/223
2,939,478 A * 6/1960 Dockrell ..... 137/223
3,727,952 A * 4/1973 Richardson ..... 251/149.1
4,569,363 A * 2/1986 Kleeman ..... 137/230
4,945,337 A * 7/1990 Huang ..... 137/233
4,970,904 A * 11/1990 Knotts ..... 137/231
5,365,967 A * 11/1994 Moore ..... 137/226
5,398,744 A * 3/1995 Street et al. ..... 137/230
5,762,095 A * 6/1998 Gapinski et al. ..... 137/223
5,819,781 A * 10/1998 Wu ..... 137/231
6,076,544 A * 6/2000 Pierce ..... 137/223
6,382,268 B1 * 5/2002 Lin ..... 137/231
6,786,247 B1 * 9/2004 Kemppainen et al. ..... 137/231
7,309,034 B2 * 12/2007 Huang ..... 239/589
2008/0271789 A1 * 11/2008 Huang ..... 137/231

* cited by examiner

*Primary Examiner*—John Rivell
*Assistant Examiner*—Craig Price

(57) ABSTRACT

An air pump nozzle includes a housing with an inflation hole. An inner space of the housing lodges a block assembly seat having a compartment at an end. The compartment lodges a block member having an insertion hole. A needle tube with an air outlet is inserted through the insertion hole and is retained to avoid being disaffiliated from the block member. The design of separate needle tube and block assembly seat can simplify the manufacturing procedure and product assembly, as well as reduce the manufacturing cost.

3 Claims, 7 Drawing Sheets

AIR PUMP NOZZLE

BACKGROUND OF THE INVENTION

1. Field of the Invention

The present invention relates to an air pump apparatus, and in particular to an air pump nozzle for engaging with an inflation valve of an inflatable object.

2. The Prior Arts

Inflation valves are universally found installed on inflatable objects, such as tires. When inflation is needed, the inflation valve is engaged with a nozzle fastened to an air hose to allow air to be pumped into the inflatable object.

A conventional inflation valve is provided with a valve needle. When the valve needle is in a standby position, the air pressure inside the inflatable object seals the air valve and prevents the air from leaking out. When the valve needle experiences an external force, the valve is opened up, which enables the inside of the inflatable object to communicate with the atmospheric air and allows air to be discharged from or charged into the inflatable object.

In general, there are two methods to inflate an inflatable object. One is to engage a nozzle fastened to a hose with the inflation valve of the inflatable object. The hose is in turn connected with an air pump or an air compressor, so that air is pumped through the hose and the nozzle into the inflatable object. The other method is to engage the nozzle directly disposed at an air outlet of the air pump with the inflation valve, so that air may be pumped through the nozzle into the inflatable object.

FIGS. 6 and 7 illustrate the structure of a conventional air pump nozzle, which comprises a housing A, whose inner space holds a needle tube E, a sleeve body D, and a block member C, and a cap B which closes the inner space of the housing A. The needle tube E is received in the block member C, which as a whole is received in the sleeve body D. A first end E1 of the needle tube E protrudes through the housing A to be connected with a hose. When the cap B is engaged with the air valve of the inflatable object, a second end E2 of the needle tube E repels against a valve needle inside the air valve, and opens the air valve to allow air to be filled in from a central hole E4.

The conventional needle tube E is structured with a tubular body having a protruded edge E3 formed at a proper position in its outer periphery. The protruded edge E3 divides the needle tube E into the first end E1 and the second end E2. The first end E1 is to be connected with a hose, while the second end E2 is to be pressed against the air valve of an inflatable object. The housing A has to be capable of rotating freely around the needle tube E in order to engage the cap B connected to the housing A with the inflation valve. To fulfill the requirement, the metal sleeve body D is disposed covering the block member C and part of the needle tube E to avoid the friction between the rubber block member C and an inner periphery of the housing A from hindering the housing rotation.

SUMMARY OF THE INVENTION

An objective of the present invention is to solve the structural problem of a conventional nozzle, wherein a sleeve body is required to isolate the inner periphery of the housing from the block member in order to avoid hindrance to the housing rotation caused by the contact therebetween. The requirement of the sleeve body complicates the manufacturing procedure and product assembly, which impedes the reduction of the manufacturing cost.

A primary feature of the present invention is to provide a block assembly seat which lodges the block member and the needle tube. The combination of the separate block assembly seat and the needle tube supersedes the aforementioned conventional integrally molded needle tube, as well as provides the isolating function of a conventional sleeve body.

One technical means of the present invention is to form a block assembly seat by mechanical machining or integral molding. At one end of the block assembly seat is a seat head with an enlarged diameter. The seat head is provided with a compartment for lodging the block member and the needle tube. A sidewall of the seat head isolates the block member from the inner periphery of the housing. The isolation prevents the housing rotation from being hindered by the friction caused by the contact between the rubber block member and the metal housing. In this respect, the block assembly seat supersedes the conventional sleeve body.

A further technical means of the present invention is, after the block member and the needle tube are lodged in the compartment of the block assembly seat, to align an air outlet of the needle tube with an air inlet of the block assembly seat, so that the air flow will not be affected. In this respect, the block assembly seat supersedes the conventional sleeve body.

An even further technical means of the present invention is, after the needle tube is installed in an insertion hole of the block member, to fit the protruded edge of the needle tube in a concave edge formed at the end of the insertion hole to prevent the needle tube from disaffiliating from the block member.

A still further technical means of the present invention is that, after the needle tube is fitted into the block member and then as a whole lodged in the compartment of the block assembly seat, which is in turn lodged in an inner space of the housing, the inner space is closed with a cap to prevent the block assembly seat from disaffiliating from the housing.

According to the present invention, the block member is isolated from the housing by the sidewall of the seat head of the block assembly seat. The isolation assures the smoothness of the housing rotation by avoiding the contact between the rubber block member and the metal housing. In this respect, the present invention supersedes the conventional sleeve body. Furthermore, the air flow from the block assembly seat to the needle tube is not affected. In this respect, the present invention supersedes the integrally molded structure of a conventional needle tube. Accordingly, the design of separate needle tube and block assembly seat according to the present invention not only simplifies the manufacturing procedure and product assembly, but also reduces the manufacturing cost.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
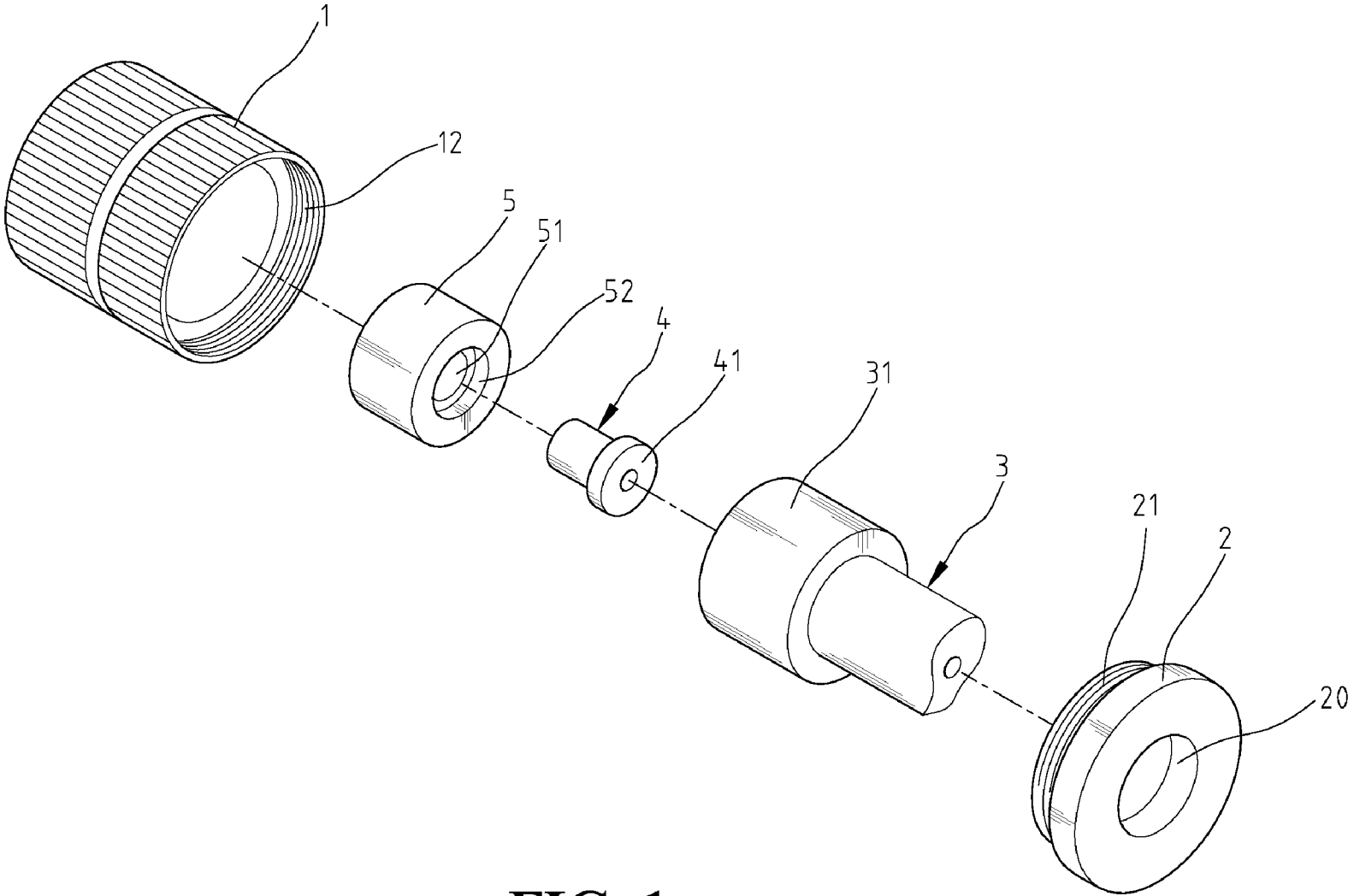
FIG. 1 is an exploded perspective view of an air pump nozzle in accordance with a preferred embodiment of the present invention.
Figure 2:
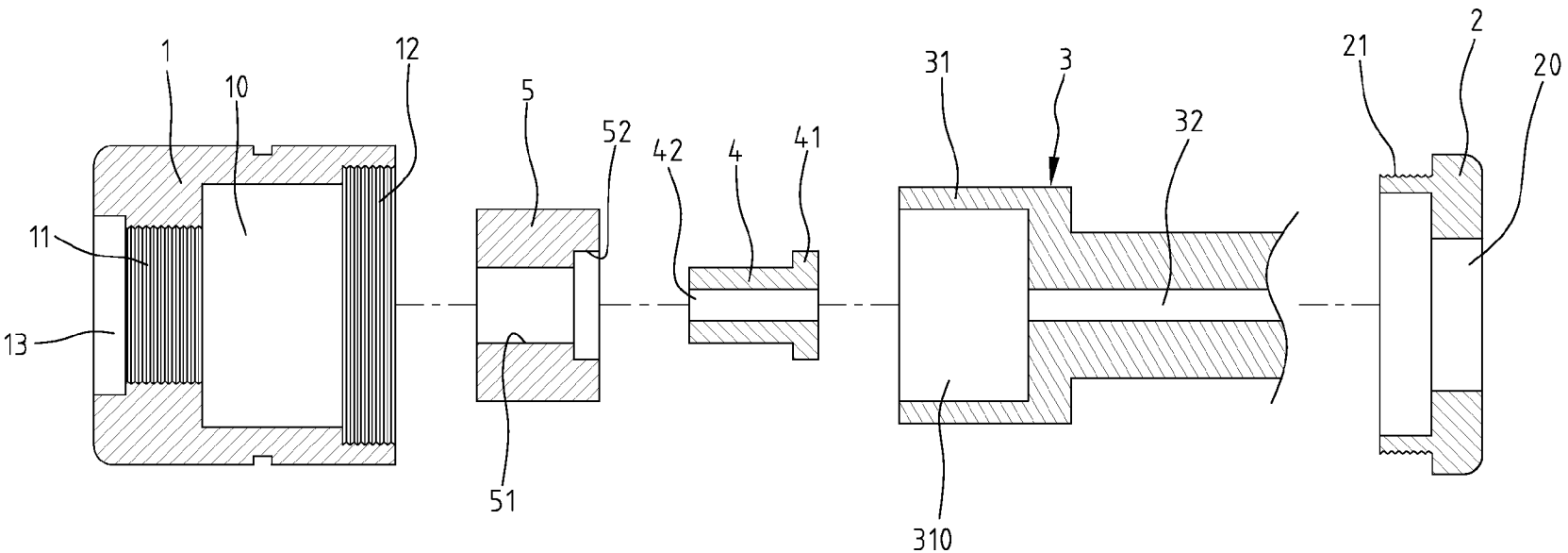
FIG. 2 is a cross-sectional view of FIG. 1.
Figure 3:
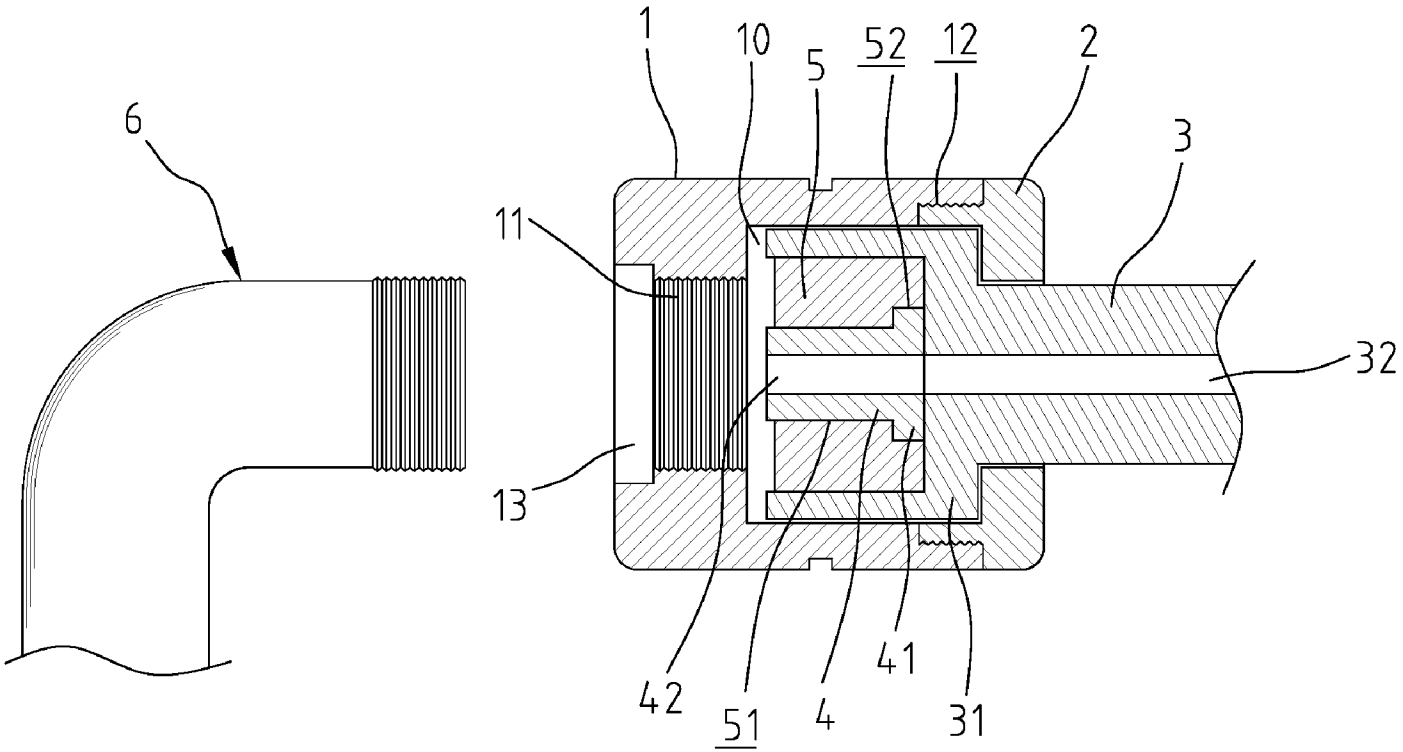
FIG. 3 is a cross-sectional view of the assembled air pump nozzle in accordance with the preferred embodiment of the present invention.

With reference to FIGS. 1-3, an air pump nozzle in accordance with a preferred embodiment of the present invention comprises a housing 1, a cap 2, a block assembly seat 3, a needle tube 4, and a block member 5. Each of the aforementioned components includes a first end and a second end. The first ends are defined with the same orientation, while the second ends are defined with the orientation opposite to the first ends.

The housing 1, as shown in FIG. 2, is not limited to any material for manufacturing, but metal is preferred for strength and hardness considerations. The first end of the housing 1 is provided with an inflation hole 13. An inner periphery of the inflation hole 13 is provided with a first inner thread 11 for engaging with an outer thread of the inflation valve of an inflatable object, as shown in FIG. 3. The housing 1 is provided at the second end thereof with an inner space 10, which is in communication with the inflation hole 13. The diameter of the inner space is greater than that of the inflation hole 13. The inner space 10 is provided at the end of the inner periphery thereof with a second inner thread 12.

The cap 2 is provided at the first end with an outer thread 21 which is in pair with the second inner thread 12, and a through hole 20 at a center thereof which extends from the first end through the second end.

The block assembly seat 3 may be manufactured with any material with proper strength and hardness, such as plastic or metal. At the first end of the block assembly seat 3 is formed with a seat head 31 with a larger diameter than the second end. The seat head 31 is provided at the end thereof with a concave compartment 310 of a proper depth. A centered air outlet 32 is extended from the compartment 310 towards the second end. The outer diameter of the seat head 31 is slightly smaller than the inner diameter of the inner space 10 of the housing 1, so that the seat head 31 may be lodged in the inner space 10. On the other hand, the outer diameter of the second end of the block assembly seat 3 is slightly smaller than the inner diameter of the through hole 20 of the cap 2, so that the second end may be inserted through the through hole 20.

The block member 5 is manufactured with material of excellent airtight performance, such as rubber. An insertion hole 51 is formed at a center of the block member 5. A concave edge 52 with an enlarged diameter is formed at an inner periphery of the second end of the block member 5. The outer diameter of the block member 5 is virtually equivalent to the inner diameter of the compartment 310 of the block assembly seat 3.

The needle tube 4 is provided with a centered air outlet 42 extending from the first end through the second end through the center of the needle tube 4 as shown in FIG. 2. The needle tube 4 is provided at the second end thereof with a protruded edge 41 corresponding to the concave edge 52 of the block member 5. The outer diameter of the needle tube 4 is virtually equivalent to the inner diameter of the insertion hole 51 of the block member 5.

Figure 4:
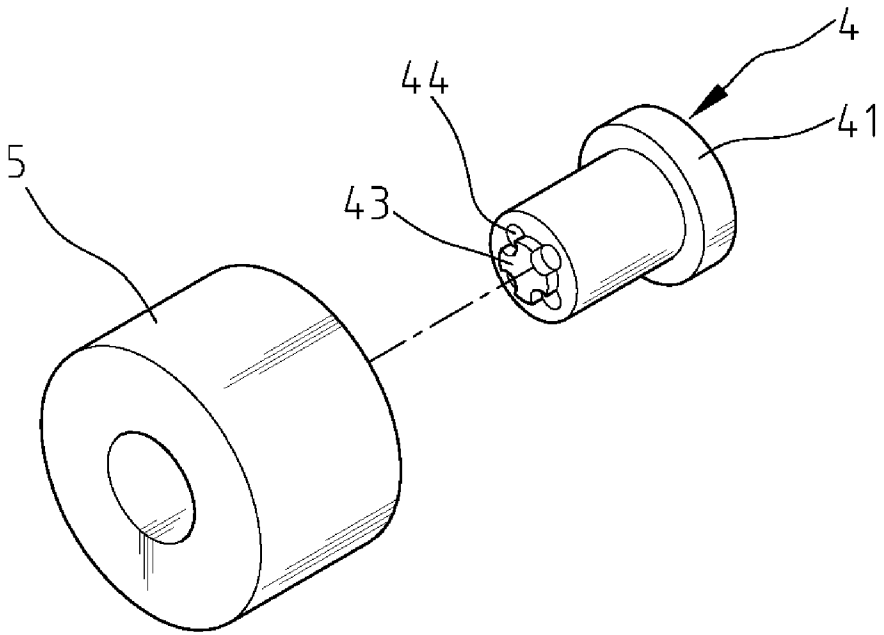
FIG. 4 is an exploded perspective view of a needle tube and a block assembly seat in accordance with another preferred embodiment of the present invention.
Figure 5:
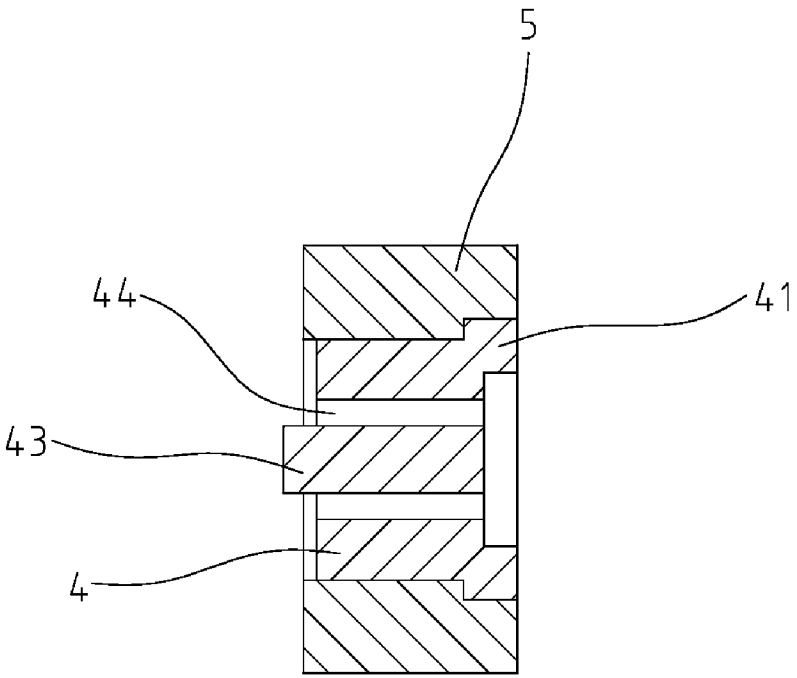
FIG. 5 is a cross-sectional view of an assembly of the needle tube and the block assembly seat shown in FIG. 4.
Figure 6:
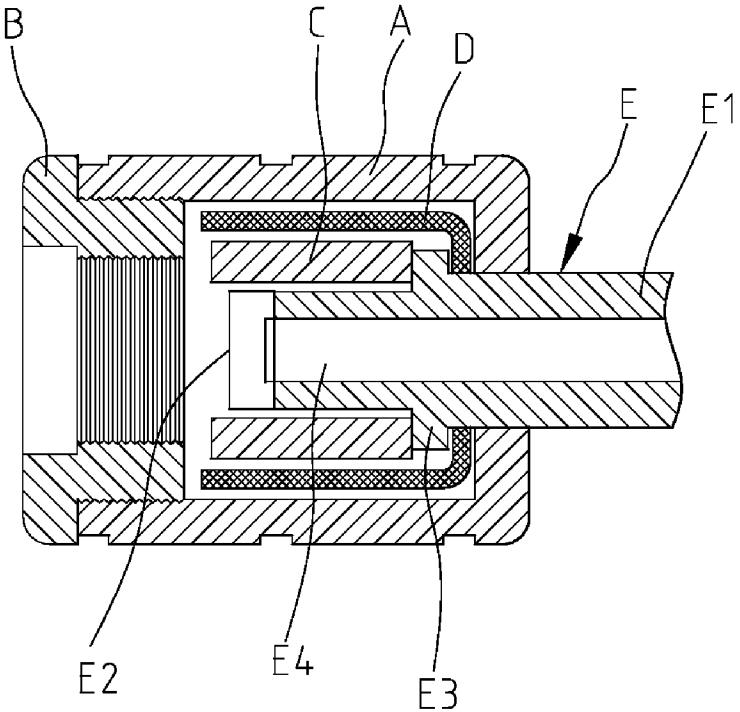
FIG. 6 (Prior Art)
FIG. 6 is a cross-sectional view of a conventional air pump nozzle.
Figure 7:
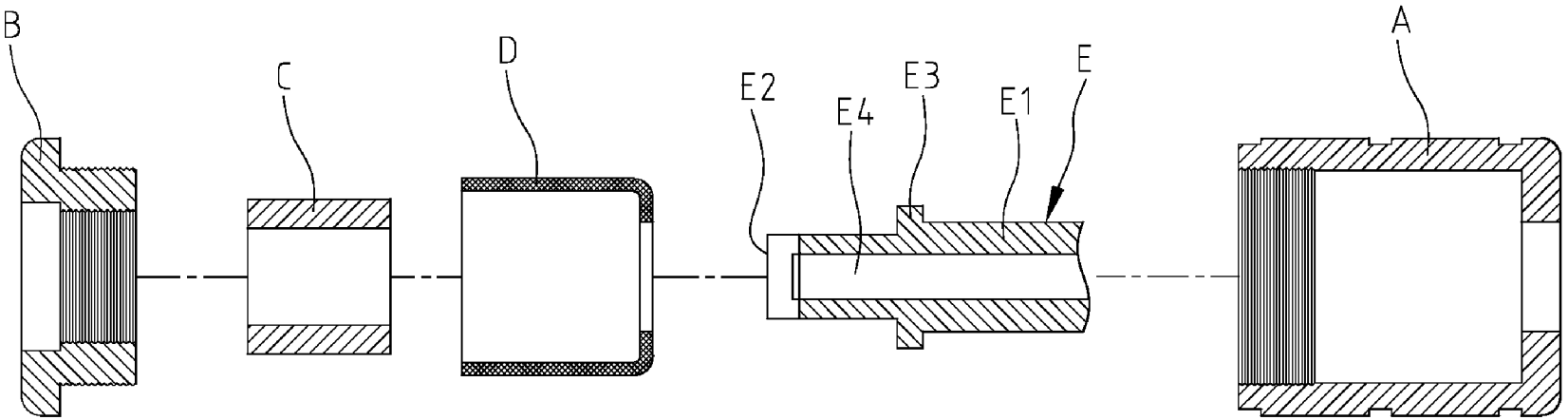
FIG. 7 (Prior Art)
FIG. 7 is an exploded cross-sectional view of the conventional air pump nozzle in FIG. 6.

FIGS. 4 and 5 depict another embodiment of the needle tube 4 of the present invention, in which a protruded central rod 43 is formed at the first end, with a number of small air slots 44 positioned around a periphery thereof extending through the second end. A protruded edge 41 is formed at the periphery of the second end of the needle tube 4. The outer diameter of the needle tube 4 is virtually equivalent to the inner diameter of the insertion hole 51 of the block member 5, so that after the needle tube 4 is inserted through the insertion hole 51 of the block member 5, the protruded edge 41 may rest against an end portion of the block member 5.

Please refer to FIG. 1 and FIG. 2 for the assembly of the present invention. Firstly, the needle tube 4 is inserted through the insertion hole 51 from the second end of the block member 5 and is retained in position by fitting the protruded edge 41 into the concave edge 52. Then the block member 5 is lodged in the compartment 310 of the block assembly seat 3 and the centered air outlet 42 becomes aligned with the centered air outlet 32 for air to pass through as shown in FIG. 3. The seat head 31 of the block assembly seat 3 is in turn lodged in the inner space 10 of the housing 1, while the second end of the block assembly seat 3 is inserted through the through hole 20 of the cap 2. Lastly, the outer thread 21 of the cap 2 is engaged with the second inner thread 12 of the housing 1, which completes the assembly thereof.

With reference to FIG. 3, the sidewall of the seat head 31 of the block assembly seat 3 isolates the block member 5 from the inner periphery of the housing 1. The seat head 31 is fitted loosely with the inner periphery of the housing 1, so is the second end of the block assembly seat 3 fitted with the through hole 20 of the cap 2. Accordingly, with the block assembly seat 3 remaining static, the housing 1 and the cap 2 are capable of rotating freely in correspondence to the block assembly seat 3, which allows the first inner thread 11 of the housing 1 to be engaged with the outer thread of the inflation valve 6.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An air pump nozzle comprising:

a housing having a first end formed with an inflation hole and a first inner thread thereof, and a second end formed with a second inner thread and an inner space in communication with said inflation hole;

a block assembly seat having a first end formed with an enlarged seat head and a compartment, and a first centered air outlet extending from said compartment towards a second end thereof, said enlarged seat head being received in said inner space;

a block member formed with an insertion hole and lodged within said compartment;

a needle tube having a second centered air outlet extending from a first end through a second end thereof, said needle tube being tightly received in said insertion hole with said first centered air outlet aligned with said second centered air outlet; and a cap having a first end formed with an external thread coupled with said second inner thread of said housing, and a second end formed with a through hole, said enlarged seat head being enclosed inside said inner space by said cap and said housing with said second end of said block assembly seat extending out through said through hole.

2. The air pump nozzle as claimed in claim 1, said second end of said needle tube having a protruded edge.

3. The air pump nozzle as claimed in claim 2, wherein one end of said insertion hole of said block member has a concave edge matching with said protruded edge of said needle tube.

* * * * *

US007588048C1

(12) INTER PARTES REEXAMINATION CERTIFICATE (0404th)

United States Patent

Huang

(10) Number: US 7,588,048 C1

(45) Certificate Issued: *Jul. 3, 2012

(54) AIR PUMP NOZZLE

(76) Inventor: Ying-Che Huang, Chang-Hua Hsien (TW)

Reexamination Request:
No. 95/001,477, Nov. 29, 2010

Reexamination Certificate for:

| | |
|---|---|
| Patent No.: | **7,588,048** |
| Issued: | **Sep. 15, 2009** |
| Appl. No.: | **11/420,004** |
| Filed: | **May 24, 2006** |

( * ) Notice: This patent is subject to a terminal disclaimer.

(51) Int. Cl.
*F16K 15/20* (2006.01)

(52) U.S. Cl. ..... 137/231; 137/223

(58) Field of Classification Search ..... None
See application file for complete search history.

(56) References Cited

To view the complete listing of prior art documents cited during the proceeding for Reexamination Control Number 95/001,477, please refer to the USPTO's public Patent Application Information Retrieval (PAIR) system under the Display References tab.

*Primary Examiner*—Robert M. Fetsuga

(57) ABSTRACT

An air pump nozzle includes a housing with an inflation hole. An inner space of the housing lodges a block assembly seat having a compartment at an end. The compartment lodges a block member having an insertion hole. A needle tube with an air outlet is inserted through the insertion hole and is retained to avoid being disaffiliated from the block member. The design of separate needle tube and block assembly seat can simplify the manufacturing procedure and product assembly, as well as reduce the manufacturing cost.

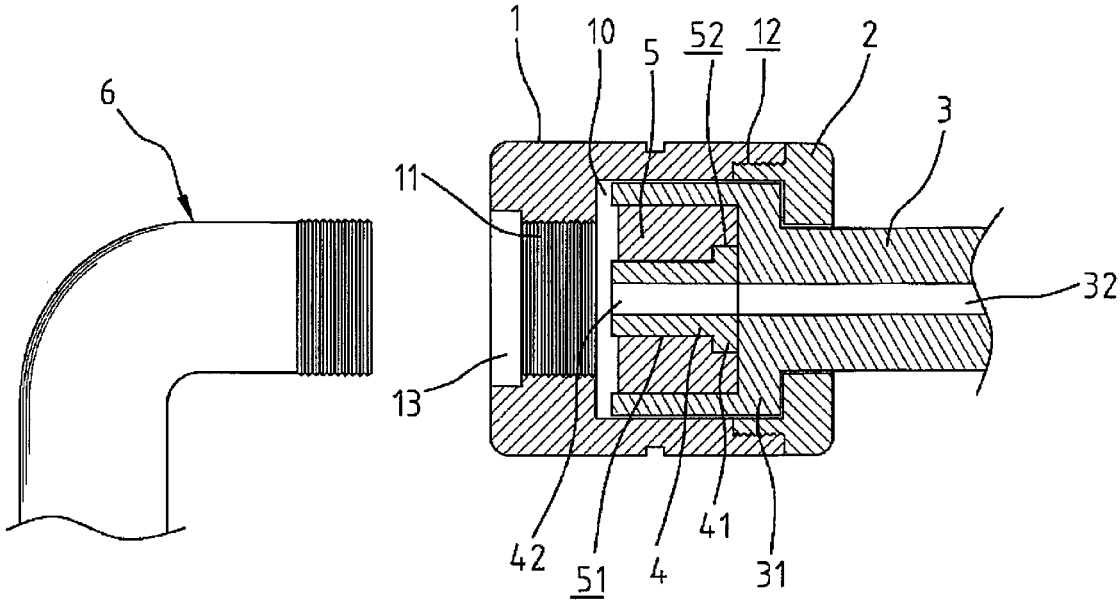

INTER PARTES REEXAMINATION CERTIFICATE ISSUED UNDER 35 U.S.C. 316

THE PATENT IS HEREBY AMENDED AS INDICATED BELOW

AS A RESULT OF REEXAMINATION, IT HAS BEEN DETERMINED THAT:

The patentability of claim 3 is confirmed.

Claims 1 and 2 are cancelled.

* * * * *